US008584404B2

(12) United States Patent
Heidenreich

(10) Patent No.: US 8,584,404 B2
(45) Date of Patent: Nov. 19, 2013

(54) MODULAR BUILDING

(76) Inventor: Bernd Heidenreich, Chorin (DE)

( * ) Notice: Subject to any disclaimer, the term of this patent is extended or adjusted under 35 U.S.C. 154(b) by 217 days.

(21) Appl. No.: 12/810,914

(22) PCT Filed: Dec. 28, 2007

(86) PCT No.: PCT/DE2007/002327

§ 371 (c)(1),
(2), (4) Date: Jun. 28, 2010

(87) PCT Pub. No.: WO2009/082991

PCT Pub. Date: Jul. 9, 2009

(65) Prior Publication Data

US 2011/0000147 A1 Jan. 6, 2011

(51) Int. Cl.

| | |
|---|---|
| ***E04B 1/38*** | (2006.01) |
| ***E04B 1/343*** | (2006.01) |
| ***E04B 1/346*** | (2006.01) |

(52) U.S. Cl.

USPC ..... 52/79.5; 52/65; 52/126.6; 52/263; 52/264; 52/236.3; 52/270; 52/274; 52/281; 52/292

(58) Field of Classification Search

USPC ..... 52/65, 79.1, 79.5, 79.9, 79.12, 284, 52/126.6, 263, 264, 236.3, 236.6–236.8, 52/285.1, 292, 299, 168, 143, 281, 270, 52/271, 274, 777–779, 781; 446/108, 111, 446/115, 117, 124, 127

See application file for complete search history.

(56) References Cited

U.S. PATENT DOCUMENTS

| | | | | | |
|---|---|---|---|---|---|
| 2,438,604 | A | * | 3/1948 | Gogerty | 52/263 |
| 3,372,518 | A | | 3/1968 | Rensch | |
| 3,653,165 | A | * | 4/1972 | West | 52/67 |
| 4,295,307 | A | * | 10/1981 | Jensen | 52/236.1 |
| 4,332,116 | A | * | 6/1982 | Buchanan | 52/82 |
| 4,346,540 | A | * | 8/1982 | Anderson | 52/274 |
| 4,571,200 | A | * | 2/1986 | Serna | 446/85 |
| 4,602,470 | A | * | 7/1986 | Stuart et al. | 52/651.1 |
| 4,630,417 | A | * | 12/1986 | Collier | 52/263 |
| 4,895,548 | A | * | 1/1990 | Holland et al. | 446/476 |
| 4,965,974 | A | * | 10/1990 | LeBow | 52/301 |
| 5,174,128 | A | * | 12/1992 | Bourne et al. | 62/373 |
| 5,737,895 | A | * | 4/1998 | Perrin | 52/745.1 |

(Continued)

FOREIGN PATENT DOCUMENTS

| | | |
|---|---|---|
| DE | 9305672 U1 | 9/1993 |
| DE | 4407000 A1 | 10/1994 |

(Continued)

*Primary Examiner* — Robert Canfield

(74) *Attorney, Agent, or Firm* — Laurence A. Greenberg; Werner H. Stemer; Ralph E. Locher

(57) ABSTRACT

A modular building is produced from base elements that include skeleton structural elements, from which a skeleton structure is formed, and planar elements with at least wall, floor, and ceiling elements attached to the skeleton structure. The skeleton structure elements are detachably connected to each other to form the skeleton structure and the planar elements are detachably connected to the skeleton structure and to each other. A method for producing a modular building that is produced from base elements, with a skeleton structure and planar elements, which include at least wall, floor, and ceiling elements being produced and/or provided as the base elements. The skeleton structure elements are detachably connected to each other to form the skeleton structure and the planar elements are detachably connected to the skeleton structure and/or to each other.

11 Claims, 15 Drawing Sheets

(56) References Cited

U.S. PATENT DOCUMENTS

| | | | | | |
|---|---|---|---|---|---|
| 5,848,507 | A | * | 12/1998 | Bozich | 52/299 |
| 5,868,574 | A | * | 2/1999 | Randle | 434/72 |
| 5,904,005 | A | * | 5/1999 | Dyer et al. | 52/71 |
| 5,918,424 | A | * | 7/1999 | Rice | 52/65 |
| 6,151,851 | A | * | 11/2000 | Carter | 52/236.3 |
| 7,310,920 | B2 | * | 12/2007 | Hovey, Jr. | 52/655.1 |
| 7,698,860 | B2 | * | 4/2010 | Hockemeyer et al. | 52/263 |
| 7,712,270 | B2 | * | 5/2010 | Guevremont | 52/235 |
| 8,011,148 | B2 | * | 9/2011 | Bertke et al. | 52/263 |
| 8,011,156 | B1 | * | 9/2011 | Schwan | 52/653.1 |
| 8,033,065 | B2 | * | 10/2011 | Paetkau et al. | 52/220.1 |
| 2002/0193046 | A1 | * | 12/2002 | Zebersky | 446/476 |
| 2006/0130422 | A1 | * | 6/2006 | De La Marche | 52/606 |
| 2008/0053017 | A1 | * | 3/2008 | Hockemeyer et al. | 52/263 |
| 2008/0053032 | A1 | * | 3/2008 | Hockemeyer et al. | 52/651.07 |
| 2008/0120925 | A1 | * | 5/2008 | Paolucci | 52/79.12 |
| 2008/0263968 | A1 | * | 10/2008 | Day | 52/79.1 |
| 2010/0132286 | A1 | * | 6/2010 | Hovey, Jr. | 52/299 |
| 2012/0005969 | A1 | * | 1/2012 | Broden | 52/79.9 |
| 2012/0233945 | A1 | * | 9/2012 | Rubel | 52/236.3 |

FOREIGN PATENT DOCUMENTS

| | | | | |
|---|---|---|---|---|
| DE | 102006014809 | A1 | | 11/2007 |
| FR | 1418008 | A | | 11/1965 |
| FR | 2087160 | A5 | | 12/1971 |
| GB | 2140058 | A | * | 11/1984 |
| GB | 2182689 | A | * | 5/1987 |
| GB | 2405879 | A | * | 3/2005 |
| IL | 186078 | B | * | 9/2007 |
| JP | 6-235222 | | * | 8/1994 |
| WO | 9964688 | A1 | | 12/1999 |

* cited by examiner

FIG. 18
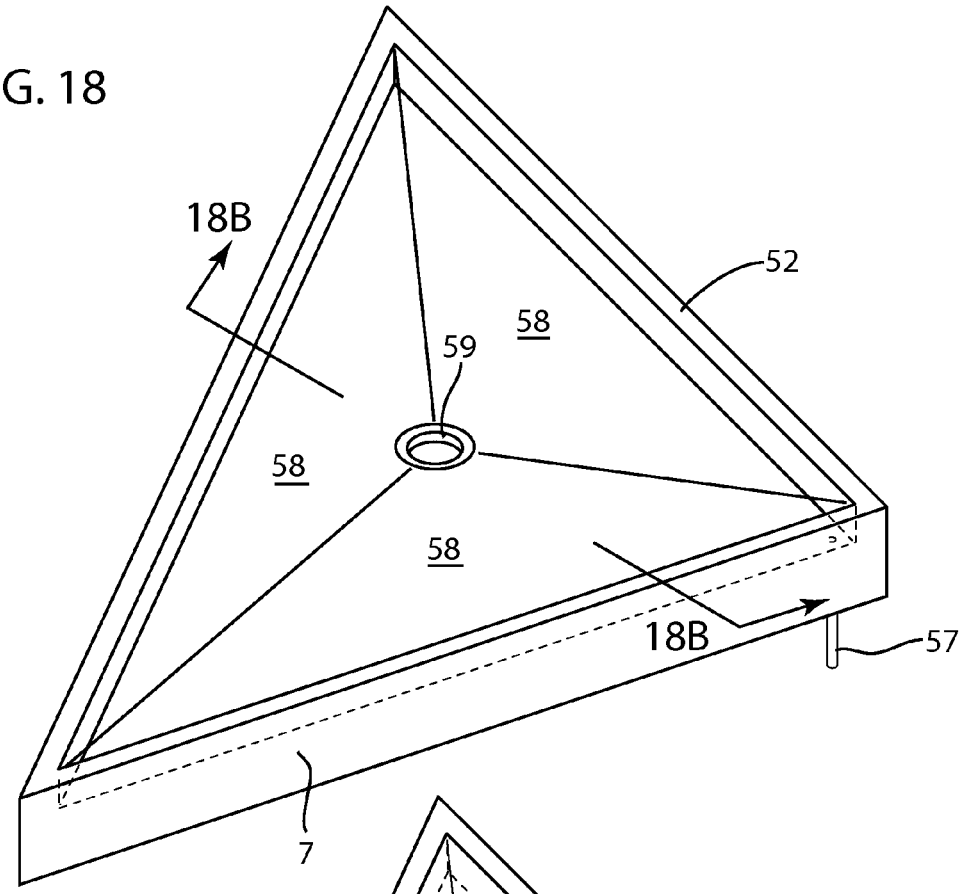
FIG. 18B
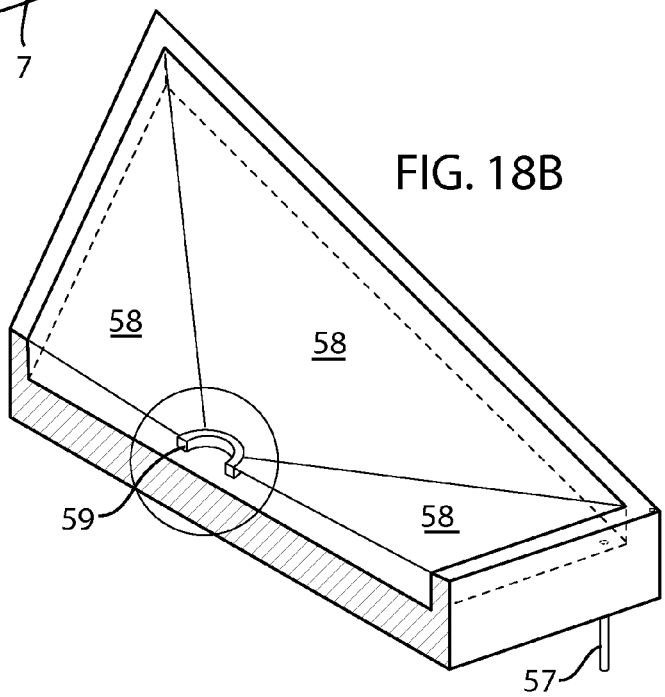
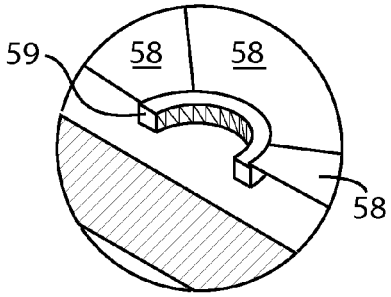
FIG. 18A

MODULAR BUILDING

BACKGROUND OF THE INVENTION

Field of the Invention

The invention relates to a modular building which is produced from base elements. In particular, the invention relates to residential, administrative and commercial buildings.

It is known in the art to erect buildings, in particular single and multiple-family dwellings and also small and medium-sized office and commercial buildings, in what is known as solid design, in which the buildings are erected from building materials at the site of their construction. A floor, walls and ceilings are erected substantially on site. This involves coordinating and carrying out a large number of operations. There is a high proportion of manual labor that is performed on the construction site; this increases the probability of error and limits possibilities for monitoring and quality assurance compared to industrially organized processes. Newly constructed buildings often have a large number of defects, elimination of which is costly or in some cases even impossible, at least at economically justifiable expense. As a result, in many cases, certain defects are permanent. Furthermore, the building process is highly dependent on weather conditions which are difficult to control.

An alternative design is known in the art in which the buildings are assembled from prefabricated elements, usually on traditionally produced cellars or foundation slabs. Some of the elements are produced with ready-to-use surfaces in industrial processes and delivered to the site of construction of the building. There, the prefabricated, delivered elements are non-detachably connected to one another. As this design has only minor cost advantages and impedes flexibility with regard to conversion measures, this "prefabricated house" design has a stagnant market share in relatively small and medium-sized residential buildings.

A further drawback of both designs and buildings known in the art is low flexibility with regard to reconfiguration during a useful life. Developments over recent decades have shown that the usage demands placed on buildings within the possible useful life, which is becoming longer and longer as a result of technical progress, are changing very frequently and in some cases very severely. In residential buildings, for example, this begins with natural variation in the number and age of the users and continues in basic changes in the habits of use. In the case of the known buildings, adapting the buildings to changed uses and external influences is in many cases disproportionately expensive.

The invention is thus based on the technical problem of providing a building and a method for the production thereof that eliminate the aforementioned drawbacks of the prior art, in particular providing a building offering high flexibility during the useful life.

BRIEF SUMMARY OF THE INVENTION

According to the invention, the technical problem is solved by a building having the features of the independent claim. Advantageous configurations of the invention emerge from the sub-claims.

A modular building which is produced from base elements is proposed, the base elements comprising skeleton structure elements, from which a skeleton structure is formed, and planar elements which comprise at least wall, floor and ceiling elements and are fastened to the skeleton structure, wherein skeleton structure elements are detachably connected to one another to form the skeleton structure and the planar elements are detachably connected to the skeleton structure and to one another. When producing a modular building which is produced from base elements, provision is thus made for skeleton structure elements and planar elements comprising at least wall, floor and ceiling elements to be produced and/or provided as base elements, and for the skeleton structure elements to be detachably connected to one another to form the skeleton structure and the planar elements to be detachably connected to the skeleton structure and/or to one another. This ensures that individual base elements can be combined with one another in a simple manner and also be simply removed again or replaced and supplemented by other base elements once the building has been erected. This allows the building to be adapted in a flexible manner to changing requirements during the useful life. A connection that can be detached without damaging the base elements, the base elements being available for reuse once the connection has been detached, is regarded as being detachable. Preferred types of detachable connection are wedging, bracing, screwing, interlocking, in particular form-fitting interlocking, nesting engagement. Examples of non-detachable connection include welding, concreting and conventional brick-laying.

In a preferred embodiment, the skeleton structure comprises vertically oriented support elements which are arranged set apart from one another at node and/or corner points of a pattern which is produced when floor elements are arranged adjoining one another to form at least a lower story area, the floor elements being mounted on the vertical support elements. This provides a simple skeleton structure.

Particularly preferably, the skeleton structure does not comprise any cross braces between the individual vertically oriented support elements. This means that the vertically oriented support elements are not connected to one another in the skeleton structure in an embodiment of this type. This provides a skeleton structure comprising vertically oriented support elements which are arranged set apart from one another and are connected to one another not via skeleton structure elements. As a result, it is easily possible to add new vertically oriented support elements to the skeleton structure or to remove such elements therefrom when the building is to be adapted. By adding or removing vertical support elements, a lower story area can easily be altered by adding or removing corresponding floor elements. A base area of the building can thus be easily varied.

In order to increase flexibility and to facilitate assemblability, the support elements are preferably composed of skeleton structure elements which are connected to one another detachably, in particular by screw connections. The individual skeleton structure elements are preferably base elements which can be carried and moved by a human being. The fact that the support elements are composed of a plurality of skeleton structure elements facilitates transportation to the construction site and at the construction site.

It is desirable for the planar elements to be provided or produced in mutually adapted dimensions. The planar elements are produced in an industrial manufacturing process at a separate location from the site of construction of the building. Increased productivity and improved quality control and quality assurance can be achieved as a result.

The planar elements, comprising ceiling, floor and wall elements, are manufactured in such a way that the surface elements are embodied so as to have finished surfaces. The term "having finished surfaces" means that the surfaces have the composition provided and required for the intended use. For example, floor elements have at an upper side a floor covering, for example floor boards, parquet or the like. Wall elements, which are provided as an outer wall and are referred to as outer wall elements, have on the outer side a weatherproof surface and on an inner side a flat, rendered and if appropriate colored surface. The inner side can also have a wood paneling, an ingrain wallpaper, textured or textile wallpaper or a roughcast. Ceiling elements, when they are provided as story ceilings in a multistory building, are provided at an underside, for example, with a smooth surface or a paneling and at an upper side with a floor covering. Roof ceiling elements have a weatherproof upper side, for example.

In addition, at least the outer wall elements are preferably provided with doors and windows.

Furthermore, the planar elements are embodied so as already to comprise installation elements. Installation elements can comprise electrical lines for the transmission of power and/or data, fiber optic cables, water, gas and waste water lines and other supply lines. Switches, outlets and inlets, shut-off devices, branching devices, etc. can also be provided.

Preferably, the planar elements are embodied in such a way that the installation elements comprise connections allowing the installation elements of adjoining planar elements to be connected.

Alternatively or additionally, the wall elements can comprise, along or adjacently to one or more rims, channel-like recesses, extending parallel to the corresponding rim, in order to receive installations. These channel-like recesses are preferably covered with closure strips.

The supply lines are preferably connected and/or distributed and/or brought together via a preferably at least crawl-high installation story located under the floor elements. The floor elements are therefore preferably propped up.

A founding takes place via foundation elements. The foundation elements are arranged, preferably set apart from one another and separately, on the construction ground, which is roughly preleveled, or sunk into the construction ground. Sinking into the construction ground is generally necessary in the external foundation elements in order to ensure frost resistance. If the construction ground displays a sufficient load-bearing capacity, steel plates can serve as foundation elements on which the support elements, in particular the installation story supports, are arranged. The foundation elements can be embodied as deep foundations only when geological conditions demand this.

In a preferred embodiment, the support elements comprise length-adjustable installation story supports in order to prop the floor elements set apart from the foundation elements or a construction ground and to compensate for uneven heights of the foundation elements or the construction ground. In one embodiment, the installation story supports comprise two threaded sleeves with opposite threads and a corresponding two-part threaded rod arranged between the threaded sleeves. The length adjustability allows subsidence occurring over the course of the useful life at individual foundation points to be easily compensated for. In another embodiment, an installation story support comprises a hollow tube on which an internally threaded nut rests in a rotatably mounted manner, what is known as a GEWI rod 13, which has an outer thread matching the inner thread, being guided in the inner thread. In this other embodiment, the GEWI rod can be retracted and extended, i.e. the length of the installation story support can be adjusted, by turning the nut.

In one embodiment of the invention, the foundation elements are arranged on circles. Steel girders or rail profiles forming complete circles are arranged on the circles. Wheels, which are mounted on the steel girders or rail profiles, are fastened to a lower end of the vertically oriented support elements in order to be able to rotate the building. The building is preferably rotatable about a vertical axis extending inside the building, preferably through a center of a base area. Stops, which limit rotation of the building to an angular range, for example 270°, are preferably provided. In this way, the supply lines can easily be supplied and removed via flexible lines. A building of this type, on which solar thermal or photovoltaic elements can also be arranged, can in this way be repositioned in accordance with a position of the sun. In an embodiment of this type, the installation story is preferably positioned above the level of the surrounding terrain.

In order to be able to carry out flexible reconfiguration and to be able to reuse the built-in base elements even after the building has been constructed, it is advantageous if the planar elements are manufactured only in a limited number of outline shapes and dimensions, i.e. in a standardized manner. Preferably, the floor elements all have the same basic geometrical shape.

The shape of an isosceles, right-angled triangle has proven to be a preferred basic shape for the floor elements. The maximum dimensions are preferably selected in such a way that the triangular floor elements can be transported by a large goods vehicle. Hypotenuse lengths of from 5 m to 6 m can thus be achieved without difficulty.

Preferably, the wall elements are story-high and the lengths thereof are adapted to rim lengths of the floor elements. On use of isosceles right-angled triangular floor elements, wall elements of this type are produced in two lengths which are adapted to a hypotenuse length and to a cathetus length of the floor elements.

If a base area or lower building area is to be more widely variable, then planar elements having different shapes and/or different dimensions can also be used. If isosceles right-angled triangular floor elements are used, then these can be produced or be used in two sizes, a hypotenuse length of the smaller floor elements preferably corresponding to a cathetus length of the larger floor elements. This allows a large number of base area sizes, in particular of rectangular base areas, to be achieved.

As the skeleton structure comprises vertically oriented support elements, it is preferable if the ceiling elements have the same shape as the floor elements. In addition, it is advantageous for the ceiling elements to have the same dimensions as the floor elements.

In a preferred embodiment, the support elements have story-high story supports which are each fastened to an installation story support arranged below or another story support. The support elements are thus preferably formed from an installation story support and one or more story-high story supports. A number of stories can be varied in this way.

In order to be able to fasten the story supports to the installation supports, the installation supports comprise in one embodiment head plates comprising fastening receptacles and/or fastening elements for fastening story supports and/or wall and/or floor and/or ceiling elements.

The story supports preferably have end plates on which the floor elements and ceiling elements are correspondingly mounted and fastened.

The story supports themselves advantageously each comprise one or more interconnected angled profiles, the opening angles of which correspond in each case to the corner angles of the floor and/or ceiling elements mounted on the corresponding story support. Handleability is increased as a result of the fact that the story supports are composed of individual angled profiles. The use of angled profiles, the opening angles of which are adapted to the corner shapes and dimensions of the floor and ceiling elements, increases the stability of the building. This is particularly true in embodiments in which the vertically oriented support elements are connected to one another not via other skeleton structure elements. In particular, in an embodiment of this type, the building is reinforced via the planar elements which are, in addition, generally configured in a self-supporting manner in the sense that they bear their own weight and do not directly weigh down on other planar elements. At least the planar elements used for reinforcement are thus embodied in a load-bearing manner. They bear their own weight, traffic and reinforcement loads.

Accordingly, the corners of the floor and ceiling elements preferably have recesses corresponding to a profile thickness of the angled profiles from which the story supports are formed. An abutting arrangement of the individual floor and ceiling elements next to one another is in this way possible.

In order to achieve effective sealing of the individual planar elements from one another, the planar elements have preferably resiliently embodied seals at rim areas at which they abut other planar elements in a planar manner.

Whereas the floor and ceiling elements are placed onto or into the vertically oriented support elements, preferably so as to engage with the angled profiles of the story supports, and are fastened to the support elements, the outer wall elements are inserted horizontally between the floor and ceiling elements between the story supports and fastened to the story supports. The wall elements also serve to further reinforce the building, in particular in embodiments in which the support elements are connected not via skeleton structure elements.

The outer wall elements are manufactured in such a way that they have projections which are flush with an outer side and laterally overlap the angled profiles of the story supports, with which the adjoining floor and/or ceiling element engages, and at the bottom overlap the adjoining floor element or ceiling element.

The inner wall elements are preferably fastened to the floor and ceiling elements. Preferably, the inner wall elements are detachably wedged or fastened through angles between the floor and the ceiling elements.

In order to save individual story supports in a story, the skeleton structure can comprise a truss in a story positioned thereabove. Relatively large support-free spaces can thus be created in the lower story.

The roof is preferably a flat roof construction. Alternatively, other roof constructions can also be implemented in which a roof frame, for example, is fastened to the skeleton structure. In a preferred embodiment with a flat roof, the roof ceiling elements have preferably peripheral upturned rims. A space which is delimited laterally by the peripheral upturned rims and downwardly by a base area is preferably sealed in a liquid-tight manner and sealed upwardly by a film as a liquid store. The film preferably comprises a centrally arranged fluid-permeable opening, a floating body being arranged around or adjacently to the fluid-permeable opening. The film is configured in such a way as to sag in a funnel-shaped manner when the liquid store is empty. If the water store is filled, then the floating body floats, so that the film forms a roof descending from the center to the sides via the water store, so that the water drains off to the sides.

In order to prevent leaves and other solid components from infiltrating the water store, the fluid-permeable opening is sealed in one embodiment with a filter, preferably a fleece filter, to prevent infiltration of solids. The filter is preferably exchangeably arranged in a mount.

At least some of the prefabricated wall elements, in particular outer wall elements, are provided with doors and/or windows.

A free space left between the construction ground and the floor elements is sealed to the sides and is used as an installation story for supplying and removing and/or distributing and/or funneling gas, water, waste water and/or power.

The invention will be described hereinafter in greater detail with reference to the figures, in which:

BRIEF DESCRIPTION OF THE SEVERAL VIEWS OF THE DRAWING

FIG. 18 is an illustration of a roof ceiling element in accordance with another particular embodiment of the invention.

FIGS. 18A and 18B cutaway views of a FIG. 18, taken along line B-B, with FIG. 18A being an enlargement of a portion of the view of FIG. 18B.

DESCRIPTION OF THE INVENTION

Figure 1:
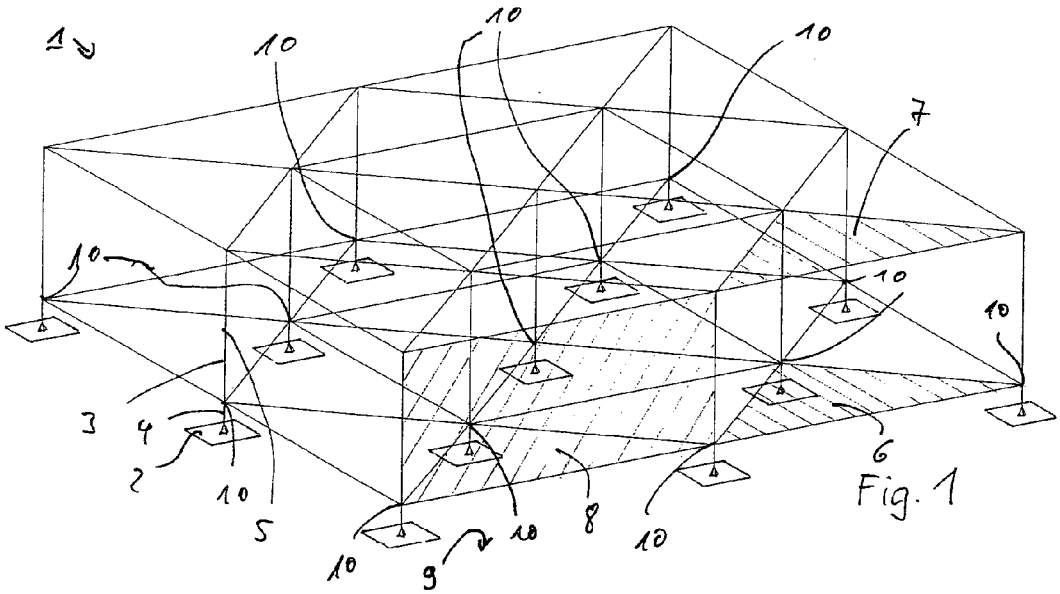
FIG. 1 is a schematic overview of an embodiment of a modular building.

FIG. 1 shows schematically an embodiment of a modular building 1. The building comprises foundation elements 2 on which support elements 3 are arranged that form a skeleton structure. The support elements 3 comprise installation story supports 4 and story supports 5.

Floor elements 6 having a triangular basic shape are mounted and fastened to the support elements 3, preferably to the story supports 5. Ceiling elements 7 are likewise mounted and fastened to the support elements 3, preferably to the story supports 5. The ceiling elements 7 have the same basic shape (base area) as the floor elements 6. In the described embodiment, this basic shape has an isosceles right-angled triangle base area. The floor and ceiling elements can also have a different geometrical base area, for example be embodied rectangularly, in a square manner, trapezoidally, etc. However, preferably, all the floor elements and all the ceiling elements have the same shape. Furthermore, the dimensions are selected in such a way that sufficiently large support-free inner spaces can be produced and, on the other hand, the individual floor and ceiling elements can be transported to a construction site on a normal large goods vehicle.

Laterally, at least outer wall elements 8 are inserted between the floor elements 6 and ceiling elements 7 and between the support elements 3. The outer wall elements are fastened at least to the support elements 3, if appropriate also to the ceiling elements 7 or floor elements 6. The floor elements 6, the ceiling elements 7 and the outer wall elements 8 form part of what are known as the planar elements. In FIG. 1 a floor element 6, a ceiling element 7 and an outer wall element 8 are highlighted by hatching and in each case only this hatched element is provided with a reference numeral.

Figure 12:
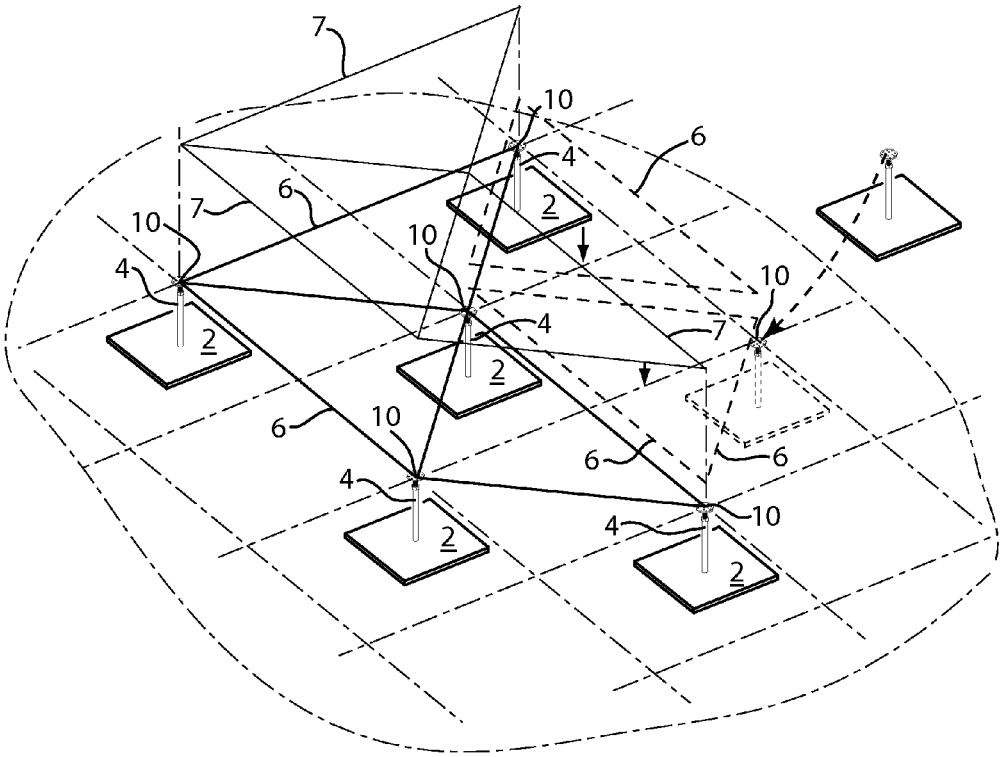
FIG. 12 is a schematic overview of an embodiment of a modular building.
Figure 12A:
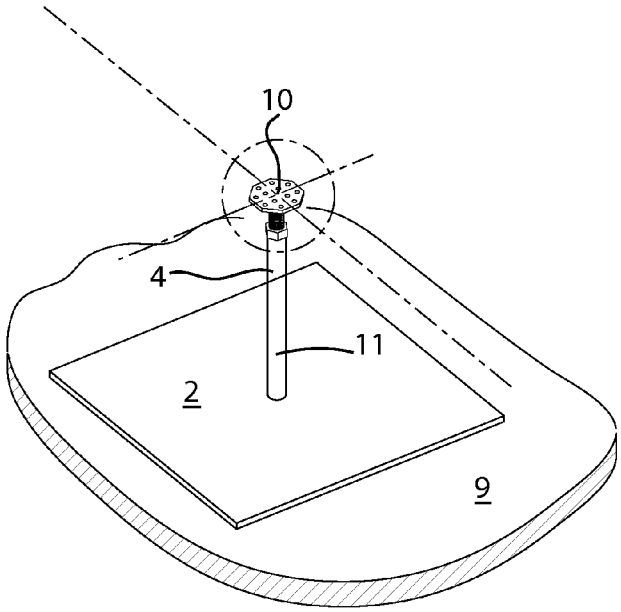
FIG. 12A is an enlarged view of a portion of FIG. 12.
Figure 12B:
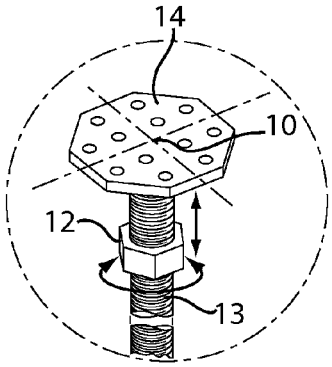
FIG. 12B is an enlarged view of a portion of FIG. 12A.
Figure 13A:
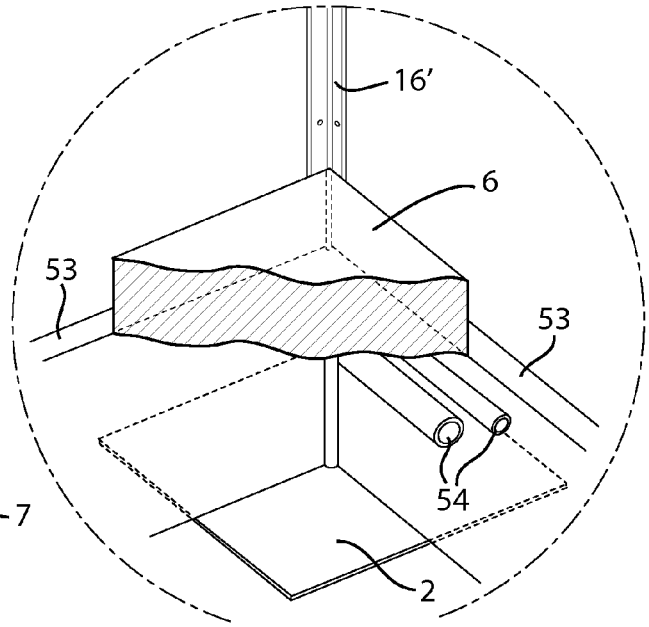
FIG. 13A is an enlarged view of a portion of FIG. 13.
Figure 13:
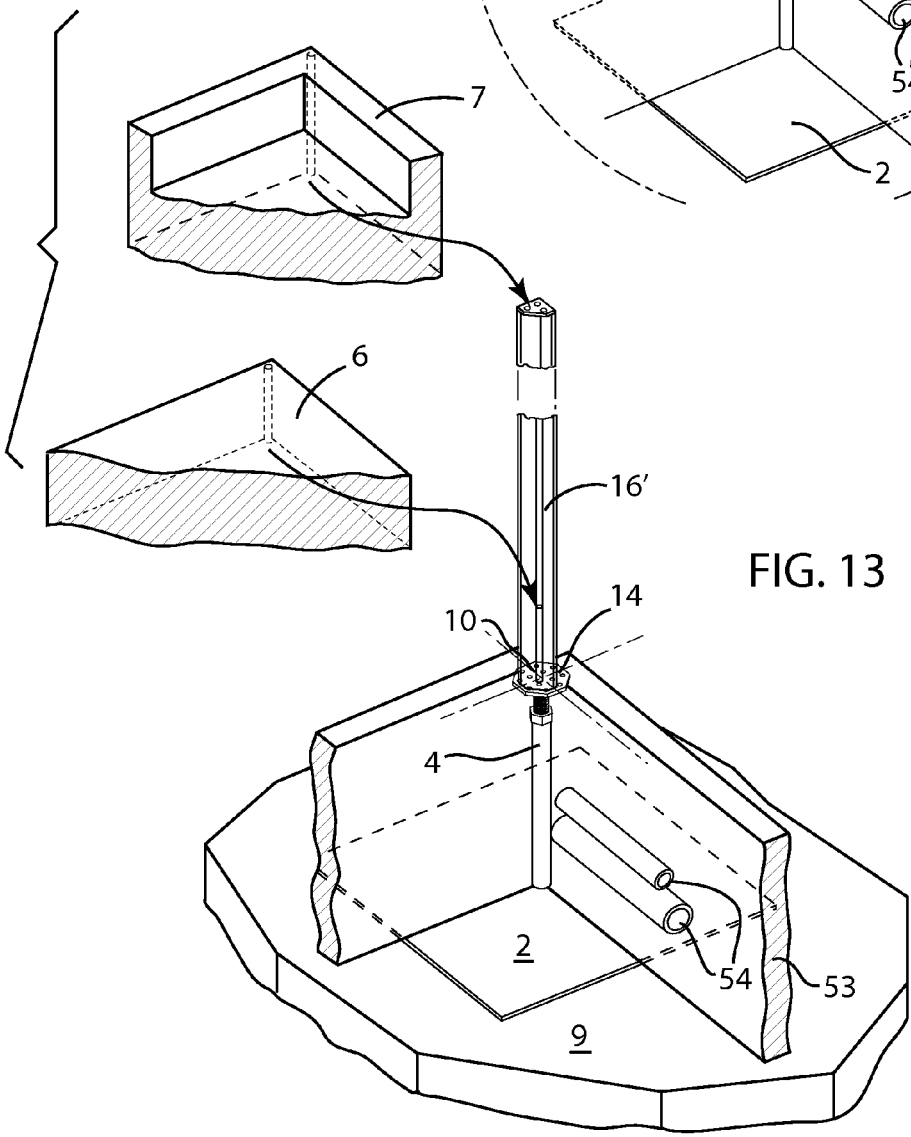
FIG. 13 is an illustration of an embodiment of the invention including a building formed over a crawl-high installation story.

An installation story, which preferably has a crawl height and is sealed to the sides, is formed between the floor elements 6, which are raised or propped via the installation story supports 4, and a construction ground 9. Special installation story walls (53 of *Fig.* 13), which are embodied for example as vertical skirts made of insulating material on a carrier layer made of sheet metal or plastics material, can be provided for this purpose. A seal can also be produced by filling soil around the building 1, as the upper floor layers are usually removed anyway, as described below. Thus, this installation story is generally wholly or partly below a level of surrounding terrain. However, the installation story is usually kept so that operators can crawl or walk on it. This is intended to ensure accessibility for repairs or modifications. In accordance with one embodiment of the invention, FIG. 12 shows a modular building wherein the floor elements 6 and the ceiling elements 7 have node or corner points 10, and the building is foundationally supported merely exactly below the node or corner points of the floor 6 and ceiling elements 7 on a construction ground 9 on reusable planar foundation elements 2, with supports of the installation story 4 fastened onto the foundation elements 2, and wherein a length adjustability of the supports of the installation story 4 allows differences in height in a foundation grade or differences in subsidence to be compensated for, and the precondition of extension or reduction of the area of the building is created by respectively adding or removing foundation elements 2 and, also, supports of the installation story 4. Additionally, FIG. 13 shows a building formed over a height of the supports of the installation story 4, with a crawl-high installation story that is delimited horizontally by the construction ground 9 and a plane of the floor elements 6, and laterally by the installation story walls 53, and in which installation strings 54 are laid, added, relaid or removed in any desired manner during use.

At least the floor elements 6 and the ceiling elements 7 are each embodied in a load-bearing manner. Preferably, the outer wall elements 8 are also configured in a self-supporting manner in the sense that they bear their own weight. Together, they serve to reinforce the building. Thus, the outer wall elements 8 are not only self-supporting in the narrower literal sense but load-bearing, as they are also embodied to accommodate reinforcement loads and/or wind loads.

The construction of a building will be described hereinafter in greater detail.

Preferably after the topsoil has been cleared, a construction ground 9 is generally subsequently compacted and leveled off. If appropriate, a leveling layer made of gravel is applied. The building is founded merely by individual supports in the node and corner points 10 of a pattern which is produced by filling out or forming the bottom story area with the aid of the floor elements 6 which adjoin one another at their rims. In the case of a construction ground displaying a load-bearing capacity, including in the case of relatively high subsidence sensitivity and long-term subsidence processes, reinforced steel plates with corresponding corrosion protection, the standard area of which results from the lower limit value of the load-bearing capacity of the most widespread types of construction ground, would appear expedient as foundation elements 2. Depending on the frost variability and composition of the construction ground 9, the foundation elements 2 have to be buried at a frost-resistant depth. In principle, this relates only to the foundation elements at external corner and node points 10, as the installation story must be kept free of frost anyway. The foundation elements 2, which are preferably embodied as steel plates, of the internal support elements 3 can be deposited onto the surface of the load-bearing construction ground 9. The foundation elements 2, which are embodied as steel plates, can accordingly be used or moved several times.

The installation story supports 4 are arranged on the foundation elements 2 embodied as steel plates. The installation story supports 4 are embodied so as to be length-adjustable and serve to achieve a frost-resistant soil cover depth and installation story height and also to compensate for inaccuracies in the height of the foundation plane and for subsidence. The installation story supports can for example comprise a lower and an upper threaded sleeve having a right and left-hand thread respectively (or vice versa) and a correspondingly two-part threaded rod. Turning the threaded rod changes a length of the corresponding installation story support.

Figure 2:
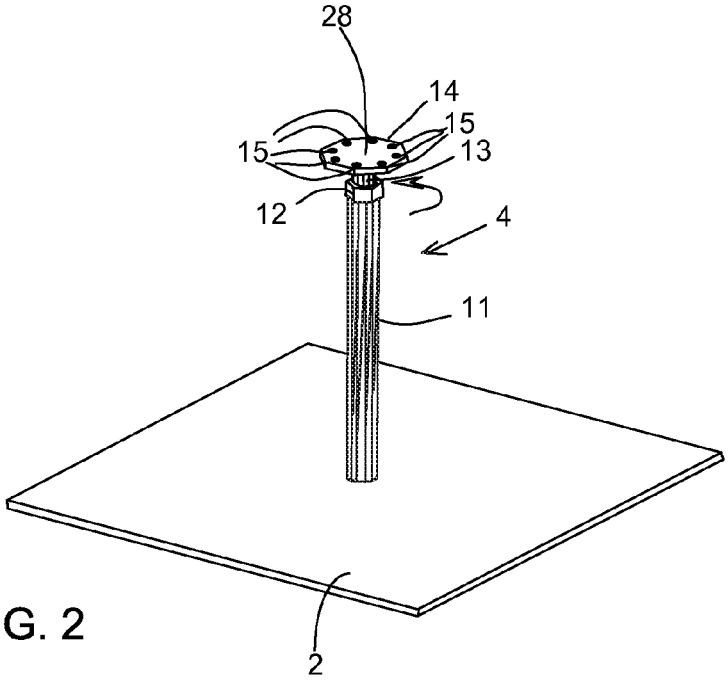
FIG. 2 is a schematic illustration of an installation story support.

Another exemplary embodiment of a skeleton structure element is illustrated schematically in FIG. 2 in which an installation story support 4 is formed integrally with the foundation element 2 embodied as a steel plate. The installation story support 4 comprises a hollow tube 11 on which an internally threaded nut 12 rests in a rotatably mounted manner. What is known as a GEWI rod 13, which has an outer thread matching the inner thread, is guided in the inner thread. The GEWI rod 13 can be retracted and extended by turning the nut 12.

A head plate 14 is attached to an end opposing the foundation element 2. The head plate 14 is preferably configured octagonally and has fastening elements and/or openings to which the story supports and/or planar elements of the building can be fastened. In the illustrated embodiment, the head plate 14 has through-openings 15.

In disadvantageous construction ground conditions, composite piles with carrier members made of BSt 500 S-GEWI in accordance with DIN 4128, for example, can be founded deep at the corner and node points. Other bored piles and also steel or reinforced concrete ram piles can likewise be used. Even in deep founding, a device for subsequent height adjustment is preferably incorporated.

During installation or production of the foundation elements, spacer blocks (for example tubes with crimped ends and boreholes at a precise distance) must be used in order to ensure accuracy of fit in the assembly of the further elements.

Figures 14, 14A:
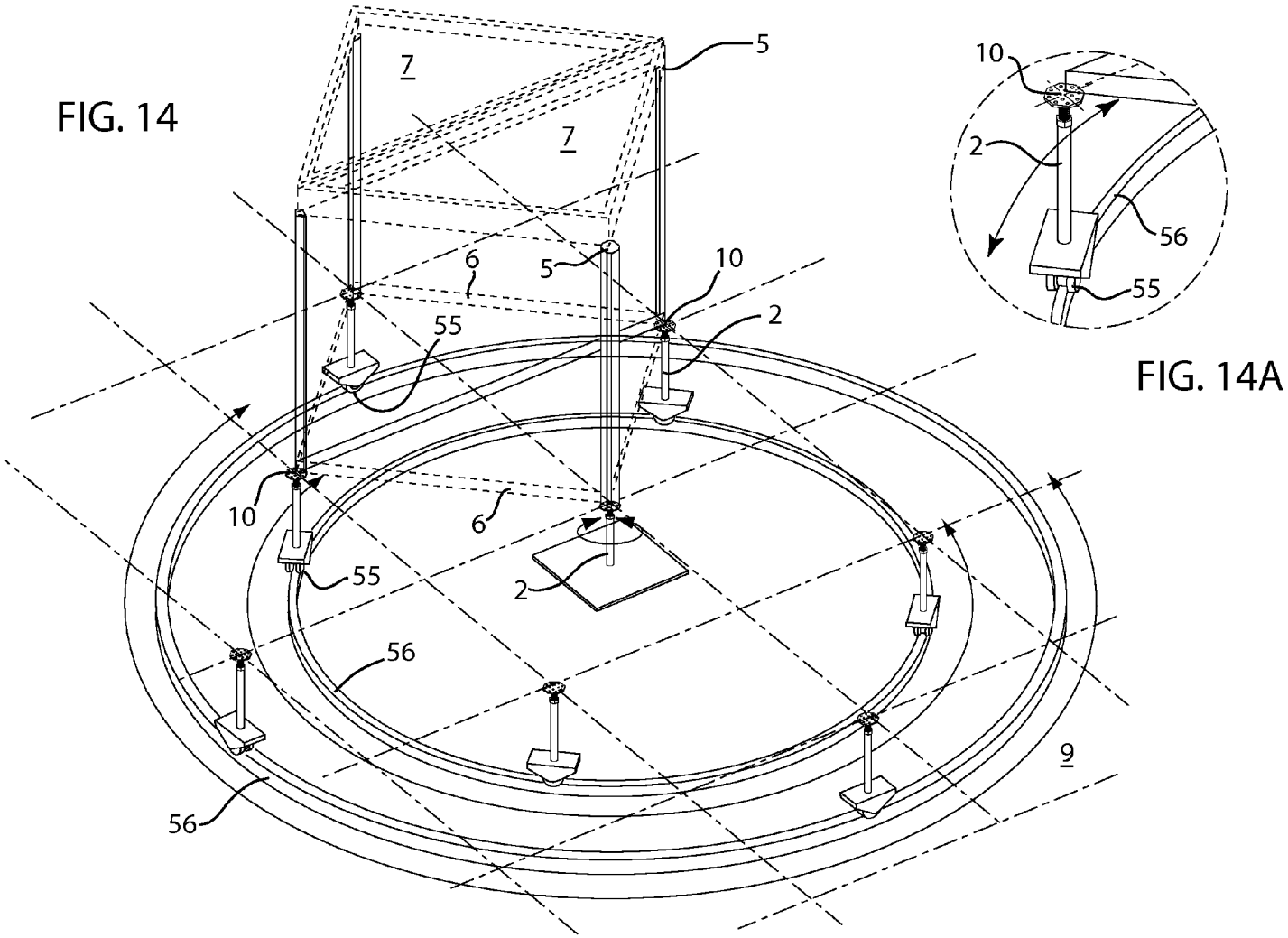
FIG. 14 is a schematic overview of a building wherein the foundation elements are replaced by wheels, in accordance with another embodiment of the present invention.
FIG. 14A is an enlarged view of a portion of FIG. 14.
Figures 15, 15A:
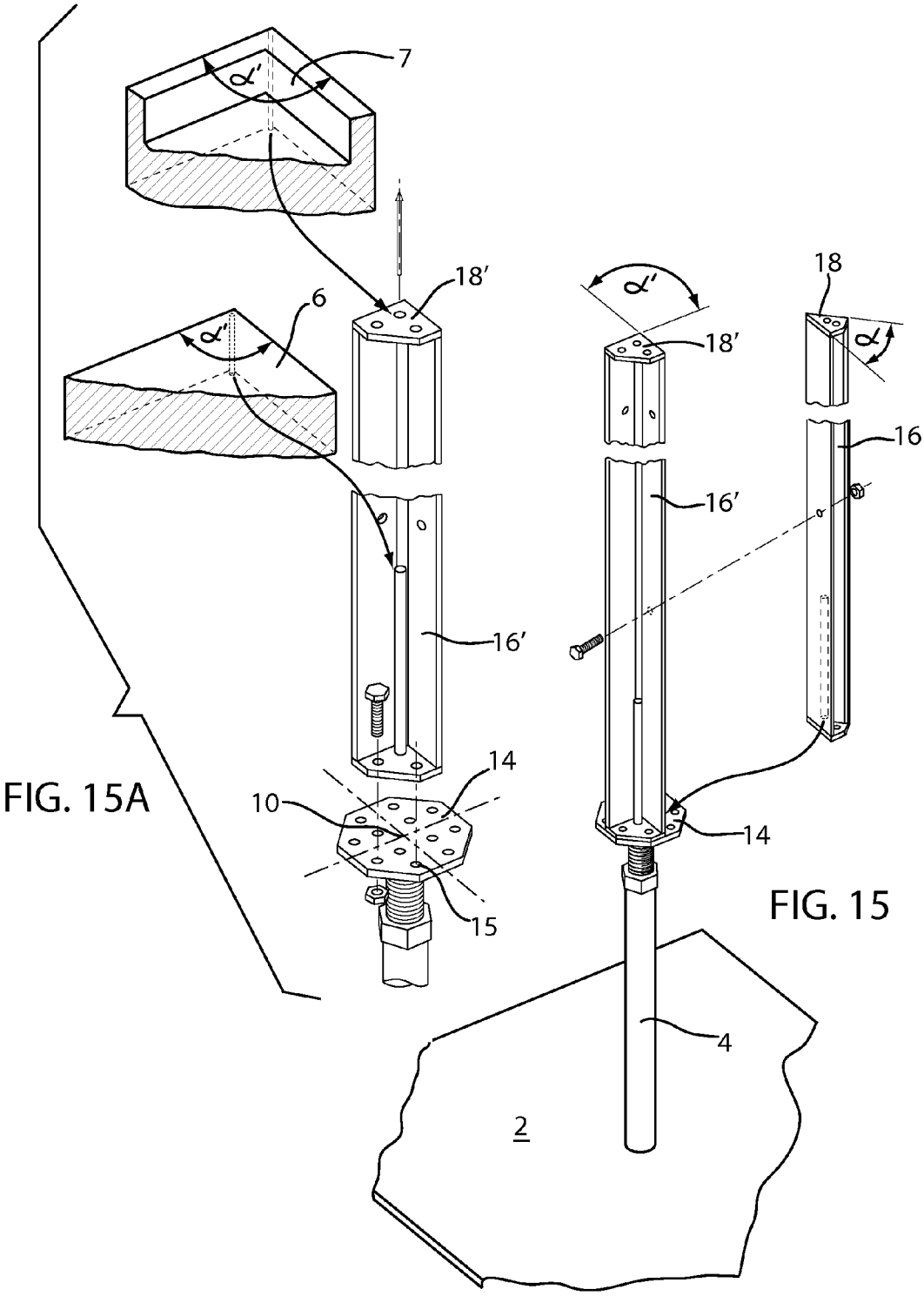
FIGS. 15 and 16 are schematic illustrations showing vertically extending story supports and supports of the installation story, respectively, in accordance with particular embodiments of the invention.
FIGS. 15A and 16A show enlarged portions of FIGS. 15 and 16, respectively.
Figure 16:
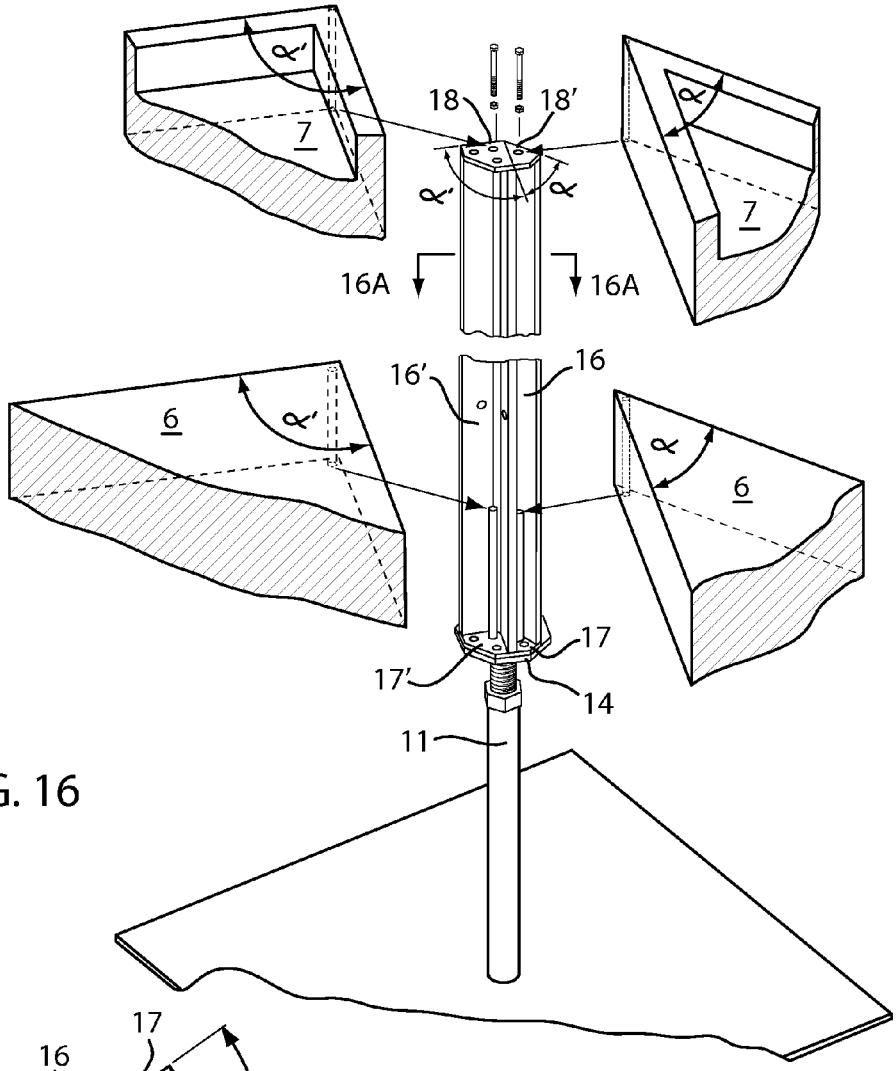
Figure 16A:
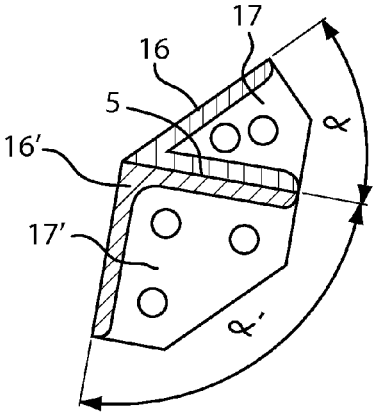

In the case of suitable outlines or appropriate reinforcements of the skeleton structure, the foundation elements can in one embodiment shown in FIGS. 14 and 14A, can also be arranged in one or more circles to which steel girders with rail profiles 56 are fastened. Steel wheels 55 with a railway or crane wheel profile run on these steel girders or rail profiles 56 and are fastened to the support elements provided at the corner and node points or to the reinforcements of the skeleton structure, thus allowing the building as a whole (except for the foundation elements) to rotate (for example following the position of the sun). The rotation takes place preferably about a vertical axis extending through an interior of the building. The axis extends preferably through a center of a base area of the building. In the case of limited rotatability through about just 270° and returning to the starting position at night, the problem of connections to the supply and disposal systems can also be easily solved. The height of the support elements does not have to be adjusted, although the rail profiles or steel girders must be oriented in a horizontally flat manner. In such a case, preferably height-adjustable elements are thus arranged between the foundation elements and the steel girders or rail profiles 56.

Figure 4:
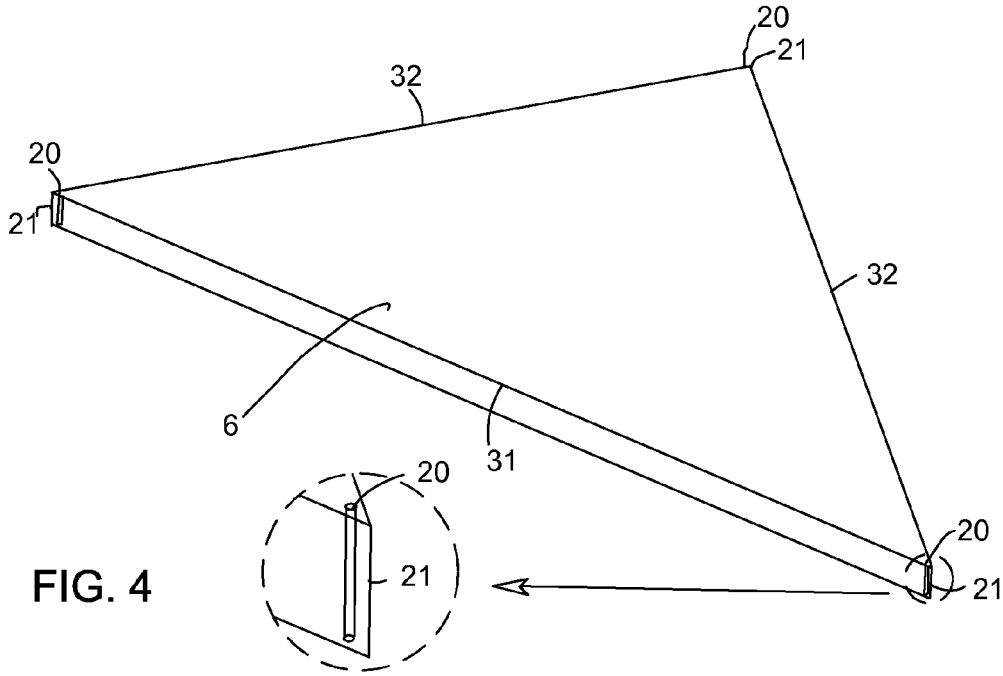
FIG. 4 is a schematic illustration of a floor element.
Figure 3:
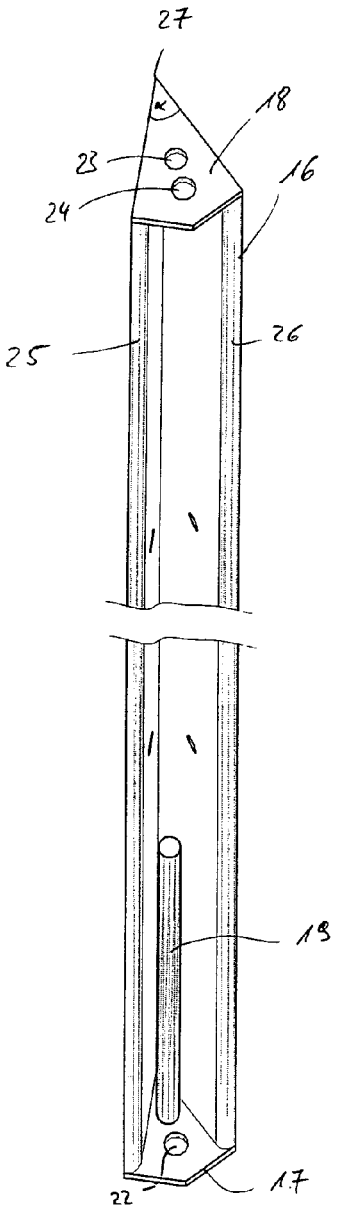
FIG. 3 is a schematic illustration of an angled profile.

The story supports 5 are fastened to the head plates 14 of the installation story supports 4. A story support 5 comprises preferably one or more angled profiles 16 which are fastened, preferably are screwed, to one another and to the head plate 14. An exemplary angled profile 16 is illustrated in FIG. 3. The angled profile 16 is embodied so as to be story-high and composed of a plurality of angled profile elements. The individual angled profile elements can in this case be connected to one another via plug-in connections or screw joints. An angle $\alpha$ enclosed by the angled profile 16 corresponds to an angle of a corner of a floor element and a ceiling element which are mounted on the angled support. For this purpose, a lower end plate 17 and an upper end plate 18 are fastened to, preferably welded onto, the angled profile 16. Other joining techniques can also be used. The lower end plate 17 has a mandrel 19. The mandrel is provided to penetrate a corresponding receiving opening 20 in a corner 21 of the floor element 6 which is mounted on the lower end plate 17. A floor element 6 of this type is illustrated schematically by way of example in FIG. 4. The receiving openings 20 may be seen in the corners 21.

The lower end plate 17 of the angled profile 16 also has a through-hole 22 which is provided for screwing the angled profile 16 to the head plate 14 of the installation story support 4 to produce the support element 3.

The upper end plate 18 comprises two through-holes 23, 24 which are arranged next to each other and are arranged relative to legs 25, 26 of the angled profile 16 in an identical manner to the mandrel 19 and the through-hole 22 on the lower end plate 17. The through-hole 23, facing a tip 27 of the angled profile 16, thus corresponds to the mandrel 19 and is provided to receive a fastening element (not shown) for fastening a ceiling element. The through-hole 23 can be provided with an inner thread. Alternatively, provision may be made for a ceiling element to comprise, like the floor element according to FIG. 4, receiving openings which have an inner thread for receiving a screw. The screw can then be guided from below through the through-hole 23, which in such a case is configured without an inner thread, into the receiving opening of the ceiling element and be screwed.

The through-hole 24, which is positioned further outward, is provided for screwing the angled profile 16 to a further angled profile of a subsequent story support. In this case, provision may be made to provide an intermediate plate (not shown) which is configured so as to correspond to the head plate 14.

Figure 5:
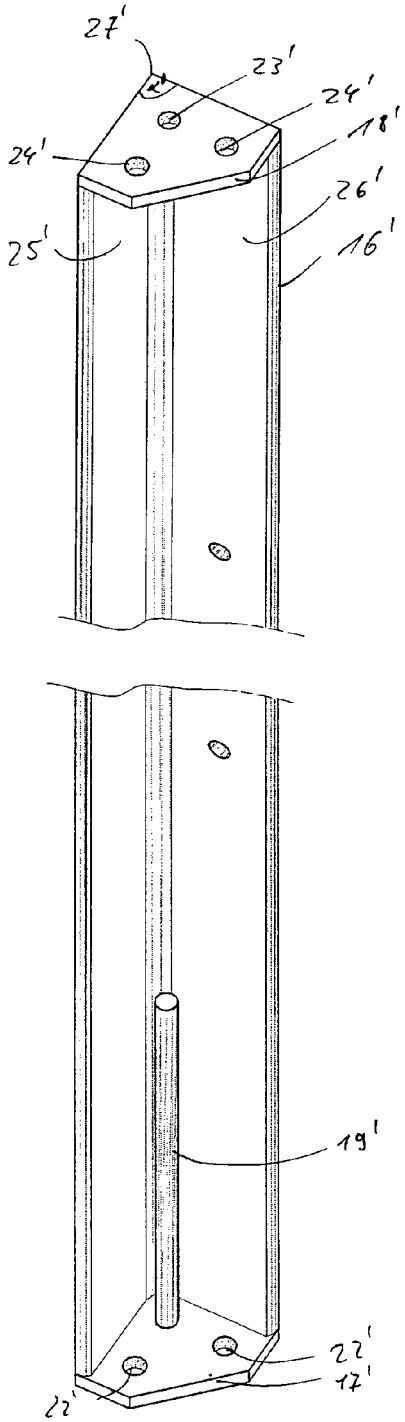
FIG. 5 is a schematic illustration of a further angled profile.
Figure 8:
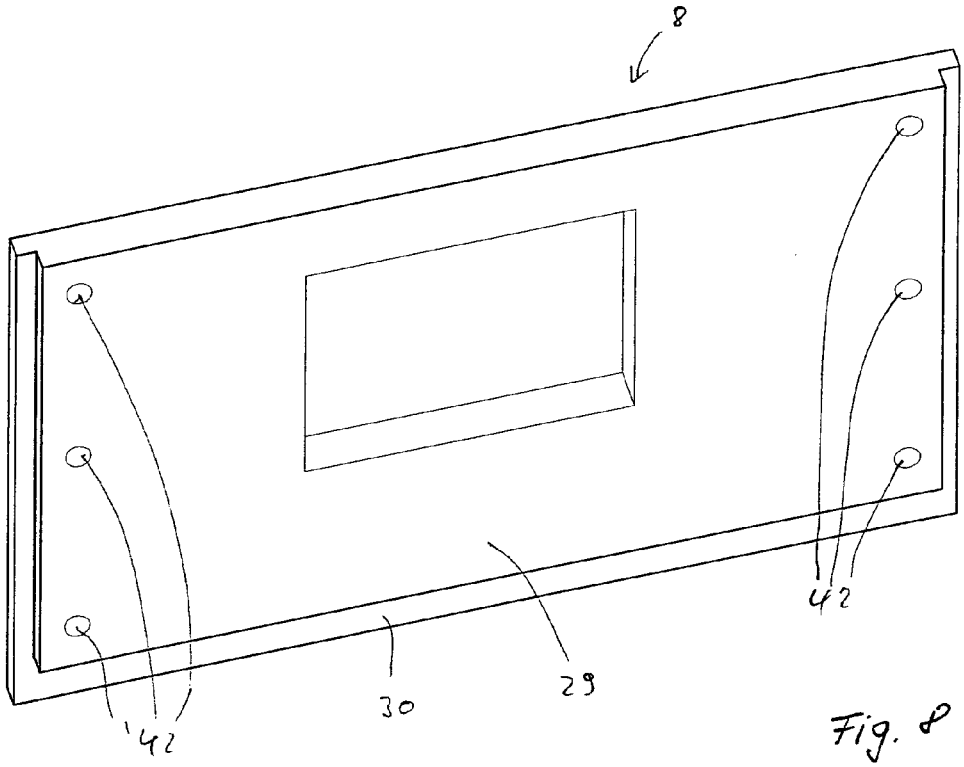
FIG. 8 is a schematic illustration of a further outer wall element.

Whereas the angled profile 16 illustrated in FIG. 3 encloses an angle $\alpha$ of 45° between its legs 25, 26, FIG. 5 shows a further angled profile 16' which encloses an angle $\alpha'$ of 90° between its legs 25', 26'. Mutually corresponding technical features are provided with the same reference numerals in FIGS. 3 and 5, an apostrophe being added to the reference numerals which refer to FIG. 5. Apart from the enclosed angle, the angled profiles 16 and 16' differ in that the further angled profile 16' has two through-holes 22' in the lower end plate 17 and accordingly two through-holes 24' in the upper end plate 18'. The angled profiles 16, 16' and the head plate 14 and also their respective through-holes 22, 22' and through-openings 15 correspond to one another. They are at the same distance from a center 28 of the head plate 14 or the tip 27, 27' of the angled profile 16, 16' and are arranged at the same angle array based on the center 28 or the tip 27'.

As mentioned hereinbefore, the floor elements 6 are placed into the story supports 5 or the angled profiles 16, 16' thereof and ceiling elements 7 are accordingly placed thereon. The corners preferably have recesses (not shown), the dimensions and depths of which correspond to the dimensions and thicknesses of the legs 25, 26, 25', 26' of the angled profiles 16, 16'. The individual floor elements 6 and ceiling elements 7 can in this way be joined to one another in each case without intermediate spaces. The floor elements 6 and ceiling elements 7 rest at their corners 21 on the end plates 17, 18. The mandrels 19 engaging with the through-holes 22 ensure that the support elements 3 maintain their defined distances from one another.

Figure 6:
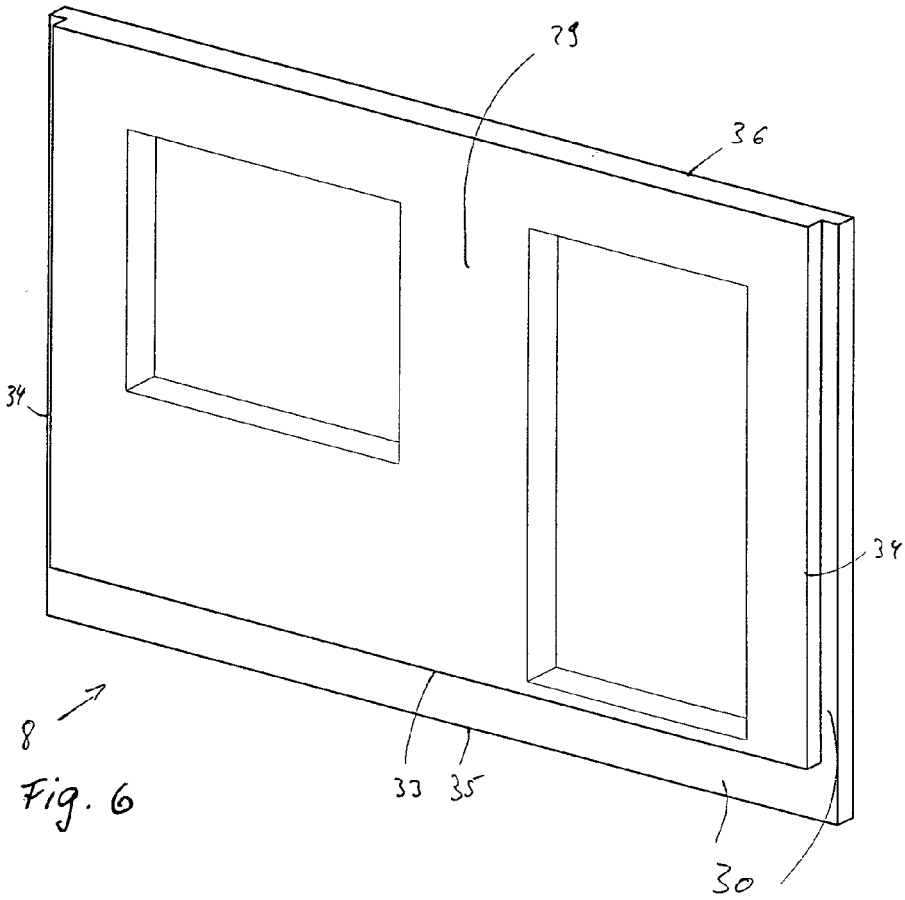
FIG. 6 is a schematic view of an outer wall element.

The planar elements comprise the floor elements 5, ceiling elements 7 and outer wall elements 8. An isosceles, right-angled triangle is preferred as the shape of the base area for the floor elements 6 and ceiling elements 7. The outer wall elements 8, one of which is illustrated by way of example in FIG. 6, have a rectangular base area shape.

The outer wall element 8 comprises a central region 29 and a projection 30 extending over the lower side 33 and lateral sides 34 of the central region 29. At an outer side, the projection 30 is flush with an outer face of the central region 29 of the outer wall element 8.

A side length of a lower rim 35 and an upper rim 36 of the outer wall element 8 (including the projection 30) is adapted to the length of a hypotenuse side 31 or the length of a cathetus side 32 of the floor elements 6 (cf. FIG. 3). The dimensions of a length of the lower side 33 of the central region 29 are such that the length corresponds to a free spacing between two adjacent story supports 5. A length of the lateral sides 34 of the central region 29 corresponds to the story height. The projection 30 is configured in such a way that it spans at the bottom a floor element 6 or ceiling element 7 (of a story ceiling) and laterally in each case the angled profile 16, 16' in or on which the adjoining floor element 6 and/or adjoining ceiling element 7 is mounted.

The individual base elements are largely prefabricated in an industrial manufacturing process. The planar elements, in particular, are delivered to the construction site as far as possible in prefabricated form.

The floor elements 6 and ceiling elements 7 are preferably identical geometrically and with regard to their base areas. They can therefore be factory-produced economically in large quantities. Particularly suitable floor or ceiling elements are

- wooden frame plates, if appropriate with statically cooperating plankings and built-in insulation,
- reinforced concrete panel slabs, or fortified lightweight or porous concrete slabs having a constant thickness.

The insulating and use layers and if appropriate claddings can also be applied in the factory, so as to be ready for use, to or under the inner structure elements. Necessary heat insulation is introduced on the upper side of the reinforced concrete panel slabs on and in the wooden frame plates.

In principle, the foregoing also applies to the ceiling elements forming a roof, at least if the ceiling elements form a flat roof.

A base area of the roof ceiling elements generally corresponds to that of the floor elements. However, upturned rims are preferably fastened to or formed at the edges of the roof ceiling elements. The bearing takes place, depending on the rigidity of the selected inner structure of the roof ceiling element, either preferably in a point-by-point manner at the corners or linearly along the circumference.

The outer wall elements 8 are also factory-produced in their entirety and so as to have finished surfaces. Suitable materials are:

wooden frame plates with built-in insulation lightweight or porous concrete slabs multilayer plates made up of different carrier, insulating and weather protective layers and also combinations of the listed building materials and components.

The outer wall elements 8 are used to reinforce the building in the preferred embodiments.

Heating, ventilation, sanitary and electric installations are preferably also prefabricated and built-in and need only be linked up and connected at the construction site. However, installations can also be fitted, and modified as required, in channels which are preferably formed at or close to the undersides of the central region as recesses extending parallel thereto in all the wall elements. Once the ceiling has been fitted, joint profiles need merely be installed on site.

(More economical) standard variants are preferably manufactured both in the window and door openings in the elements and in the finished electric or other installation. However, any special design can also be produced. There is a special feature in the complete glazing of the entire grid area between two adjacent support elements 3. The glazing elements consist of a stable base frame made up of cross sections which are as narrow as possible and partial elements fastened therein, some of which may be openable or displaceable, which should be able to be moved by hand in order to allow straightforward changes between winter and summer, for example, i.e. between use as a winter garden and terrace or loggia.

Figure 7:
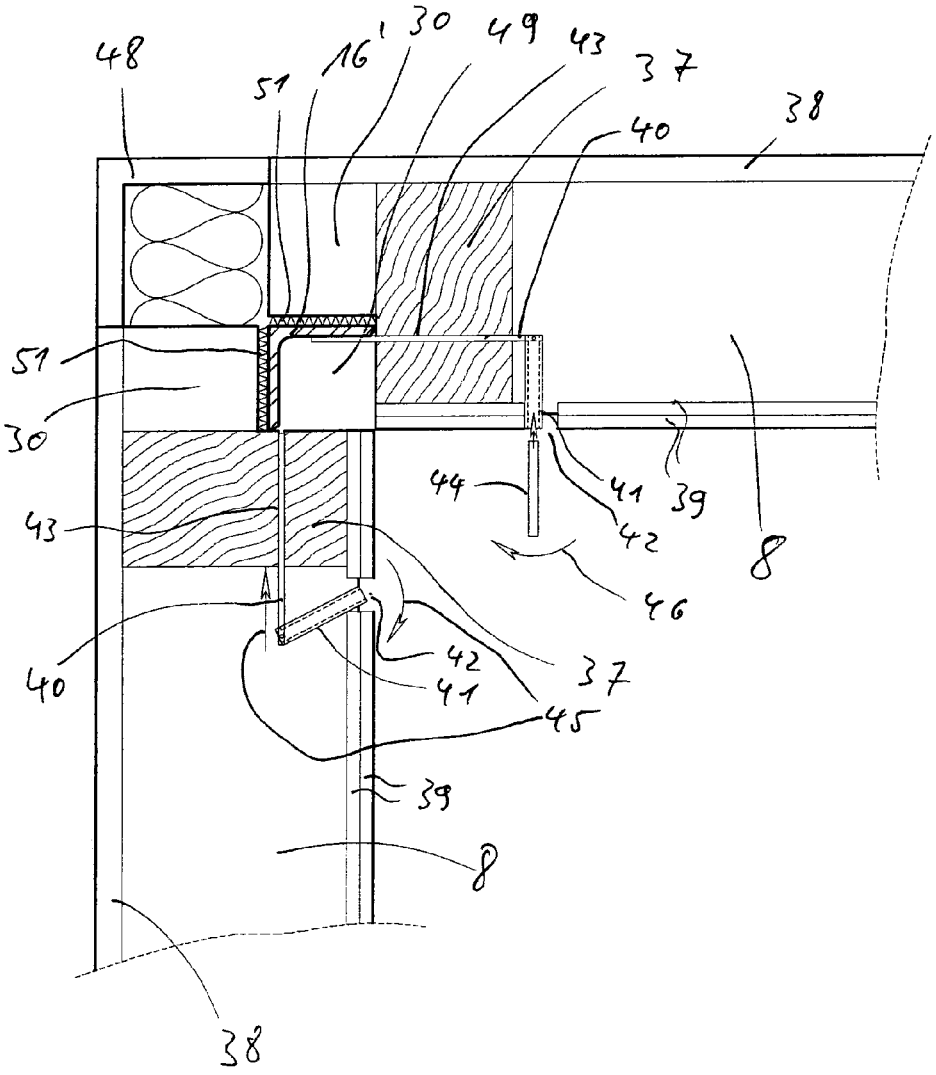
FIG. 7 is a schematic illustration of a building ceiling.

The outer wall elements are horizontally assembled from the outside and detachably connected (for example screwed or wedged) to the supports. FIG. 7 shows schematically a story support 5 which comprises a right-angled profile 16' and to which two outer wall elements 8 are fastened. The outer wall elements 8 comprise inner structure elements 37 to which an outer weather protective layer 38 and inner layers 39 are fastened. The projections 30 overlap the angled profile 16'. A resilient sealing layer 51 is in each case arranged between the angled profile 16' and the projections 30. Further layers, for example insulating layers, installations, etc., can be arranged between the outer weather protective layer 38 and the inner layers 39. In the illustrated embodiment, the outer wall elements 8 are wedged and fastened to the angled profile 16 by pins 40. The pins 40 are articulated at one end to a locking sleeve 41. The pins 40 can be actuated with the locking sleeves 41 in the respective outer wall elements 8 through locking openings 42. The pins 40 are guided in a guide 43 in the skeleton structure element 37. A lever rod 44 can be introduced into the locking sleeve 41. The locking sleeve 41 can be supported at edges 45 of the locking opening 42, so that a pivoting movement of the lever rod 44 can cause the pin 40 to be fastened (pivoting along the arrow direction 45) or detached (pivoting along the arrow direction 46). The error ranges caused at outer corners 47 by the overhanging wall element thickness are also closed by a finished element 48. If there are any inner corners, for example in atria, special elements must be produced with at least one lateral door case support and adjoining shortened wall plate for ensuring horizontal assemblability. A free space 49 remaining in the angled profile 16' can be used for receiving installation lines.

The inner walls can be produced as conventional plasterboard stud walls without particularly stringent demands being placed on flexibility. More flexible, however, are inner wall elements which can preferably be moved by hand and are braced between the floor element and ceiling element, detachably bonded or fastened with angled brackets or skirting boards on both sides which are screwed to the ceiling element and the floor element. The elements are connected in a sound-absorbing manner by fitting permanently resilient material in grooves at the edges of the elements. In addition to the necessary elements, a "normal element", at least two corner elements and the door element, different special elements can also be manufactured. An element width of preferably approx. 1.25 m would appear to be most expedient.

The installations can in this case likewise be fully installed in the factory and linked or connected to one another via plug connectors or be subsequently fitted through preformed channels at the undersides of the elements.

Wooden or metal frames with plankings made up of plasterboards or wood-based materials (plywood, chipboards, OSBs, etc.) are most suitable as materials for inner wall elements.

Figures 9, 9A:
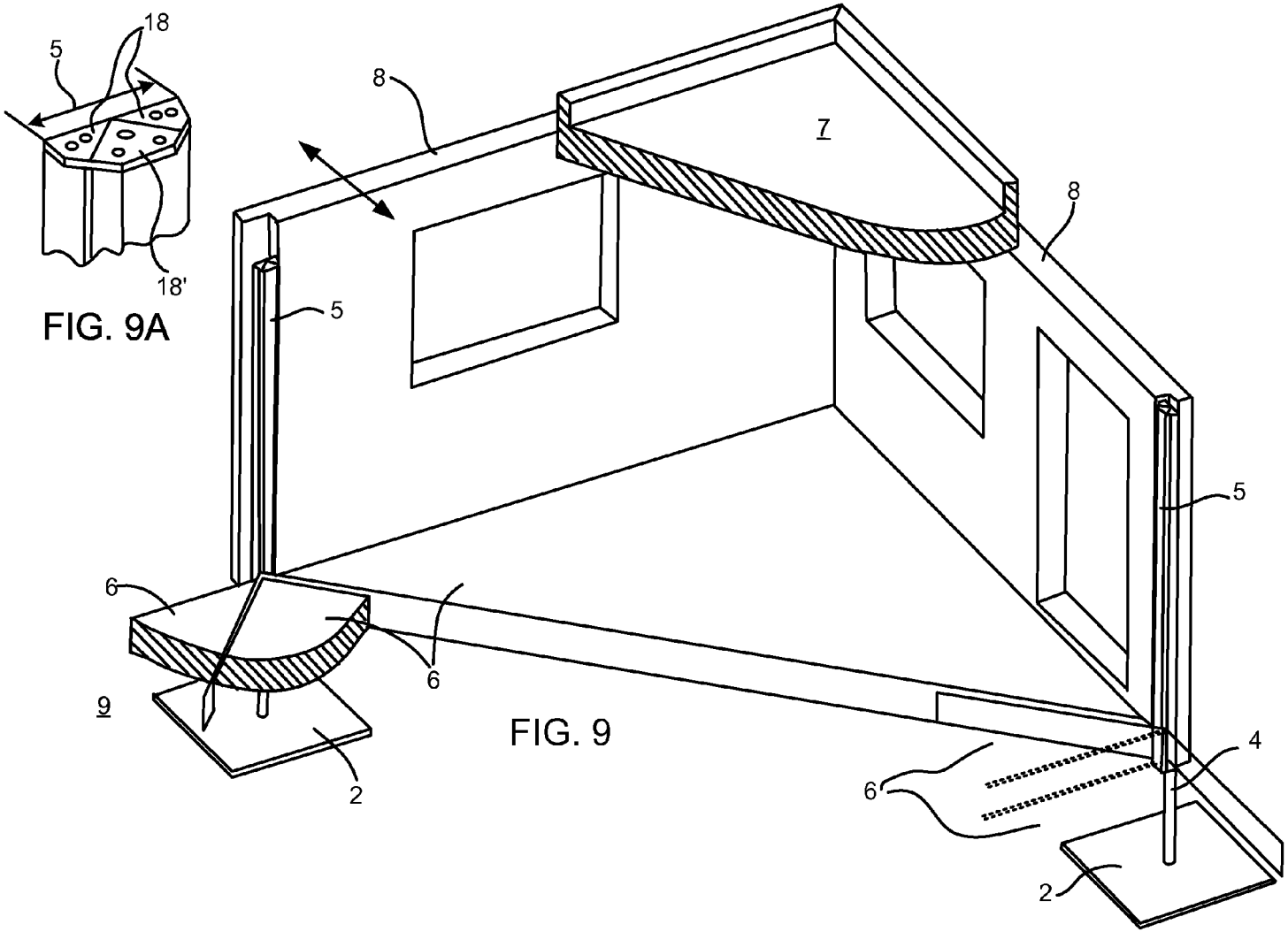
FIG. 9 is a schematic illustration of a further building ceiling of a single-story building.
FIG. 9A is an enlarged view of a part of FIG. 9, showing a story support formed from the bundling of the angled profiles of FIGS. 3 and 5.
Figure 10:
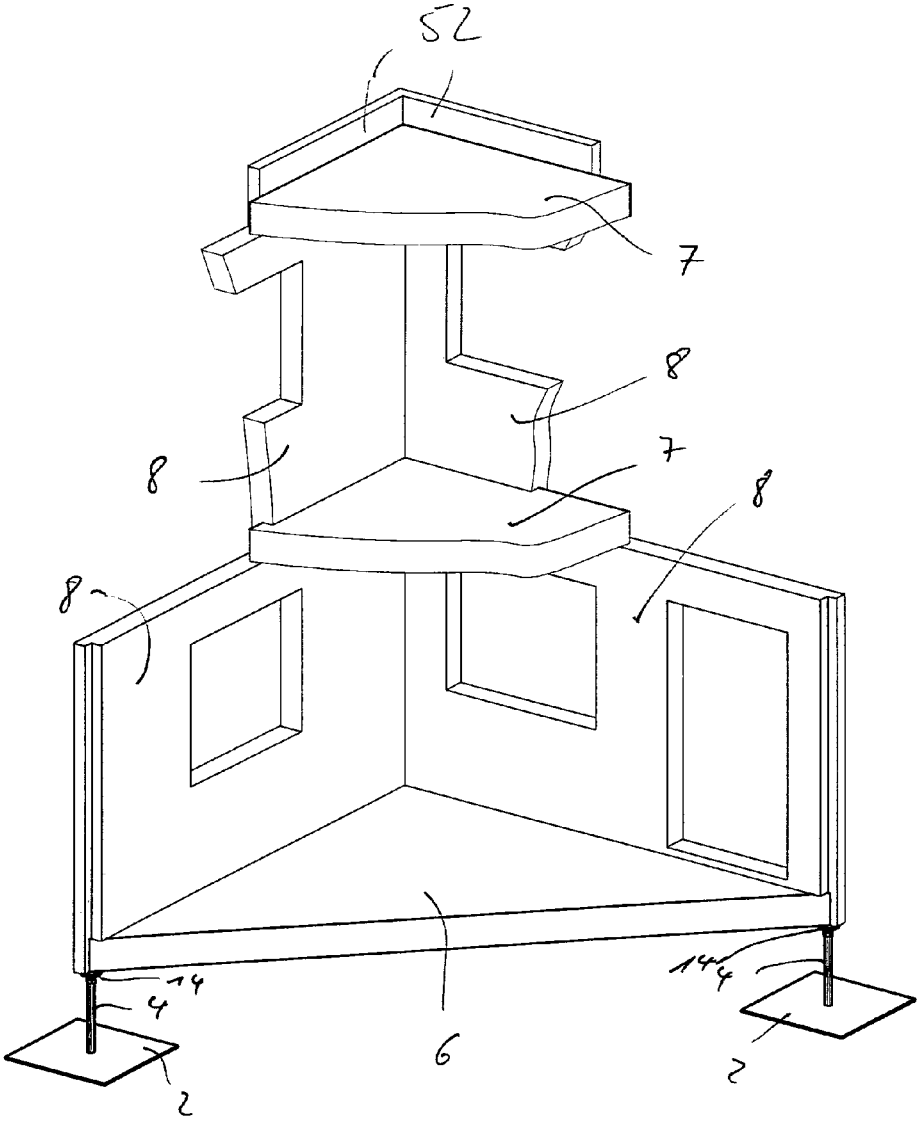
FIG. 10 is a schematic illustration of a building ceiling of a two-story building.
Figures 17, 17A:
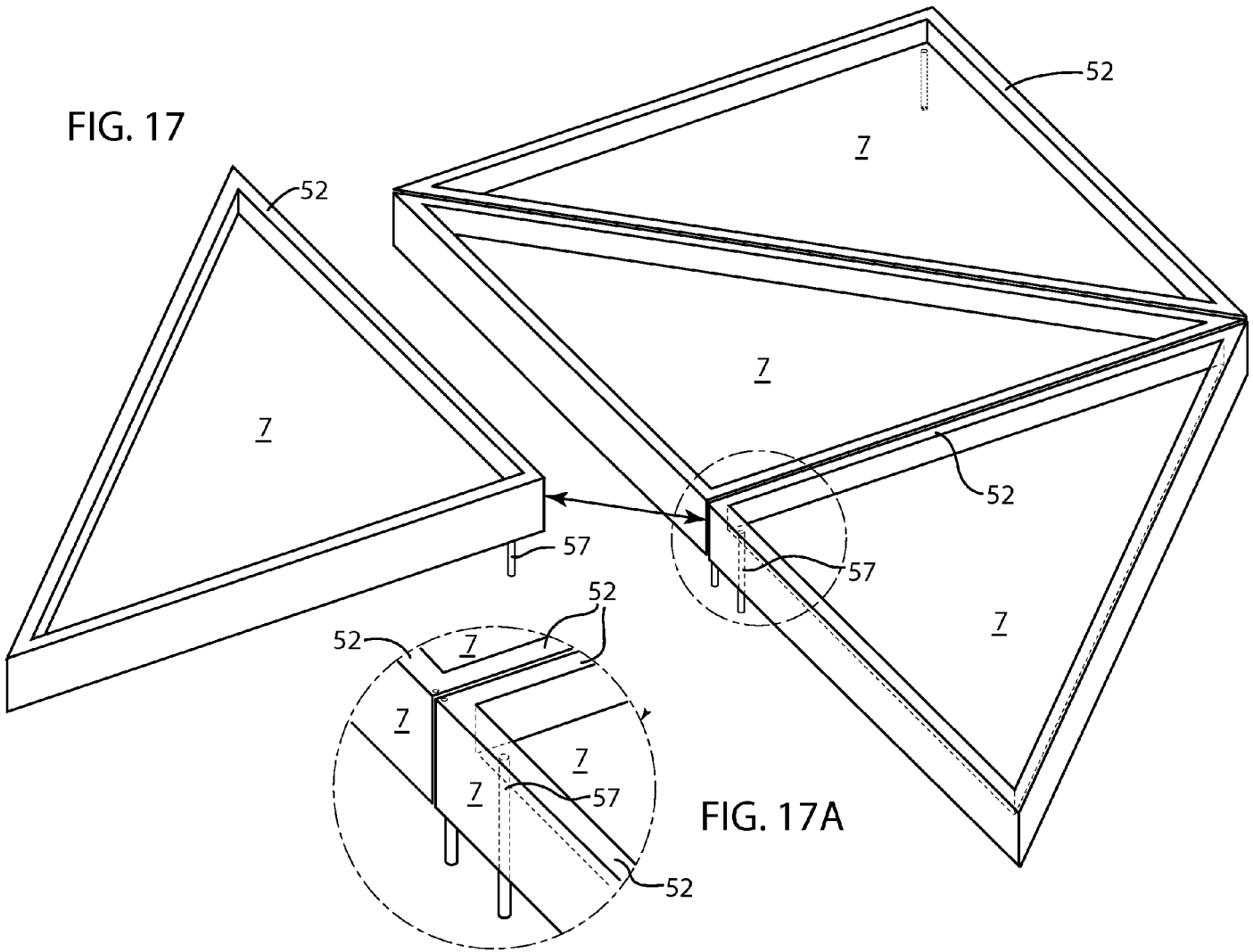
FIG. 17 is a partially exploded view of roof ceiling elements in accordance with one particular embodiment of the invention.
FIG. 17A is an enlarged view of a portion of the roof ceiling elements of FIG. 17.

The most economical roof shape is a flat roof made up of prefabricated elements. In a preferred embodiment, the roof ceiling elements, which in principle correspond to remaining ceiling elements, are given peripheral upturned rims 52 which may be seen by way of example in FIGS. 9 and 10, which each schematically show a corner of the building, and in FIGS. 17, -18B. FIG. 10 shows a two-story building 1'. The heat insulation and sealing in flat roofs are likewise already constructed in the factory. Adjacent upturned rims 52 are clamped-over by U-shaped profiles. Drainage is then carried out one element at a time using downpipes 57 in the support claddings or by short-circuiting the roof ceiling elements and channeling into a few downpipes 57. The roof ceiling elements with upturned rims 52 also allow rainwater to be collected as service water and to be stored on the roof. For this purpose, the troughs formed by the upturned rims 52, for example, are used and lined with a foil 58. Just under the upper rim of the troughs, a second film plane is fastened to the upturned rims 52 all the way round. This second foil 58 has at its center an opening with a screen filter, which is preferably embodied as a fleece filter, and a peripheral floating body 59 at the edge of the opening. When the store is empty, the rainwater runs, as a consequence of the sagging of the upper foil 58, through the opening, where it is stored between the film planes, protected from contamination. When the store is full, the floating body 59 rises and the rainwater runs to the edges of the roof ceiling elements, where it is discharged as in the case of the above-described "normal" roof ceiling elements. If dark foils are used, the service water can also be heated. The stores have in a corner of the roof ceiling elements drain lines which are guided within the support claddings into the installation story, where they are brought together. From there, the water is supplied to the consumption points. If there were a risk of frost, the stores could be additionally heated or the water could be discharged from the installation story without being stored.

Likewise, solar or photovoltaic elements can also be attached to flat roof elements while still in the factory. This is also possible in the rainwater-storing roof ceiling elements described hereinbefore.

Suitable building materials for the roof ceiling elements correspond to those of the story ceilings.

However, other roof shapes, such as gabled, hipped, high pitched or monopitch roofs, can also be implemented. For this purpose, an auxiliary construction made of steel or wood is set up, on which traditional wooden roof frames, for example, are deposited. Nevertheless, this reduces the overall flexibility of the building. However, even in this case, the construction of standardized solar or photovoltaic installations would appear beneficial, in particular if the building is rotatably mounted.

In order to insert stairs, any type of quarter wound stairs are preferred in the favored triangular floor and ceiling elements. Nevertheless, the stairs should consist of a plurality of components in order to obtain in this case too a certain, albeit less frequently required, flexibility. A broad range of stair shapes and designs can be used in the production of special ceiling elements with special stair recesses. Whether special elements with stair openings are expedient or whole areas are left clear for guiding through the stairs depends on the size and shape of the base elements.

A multistory design is of course possible, as may be seen from FIG. 10.

Figure 11:
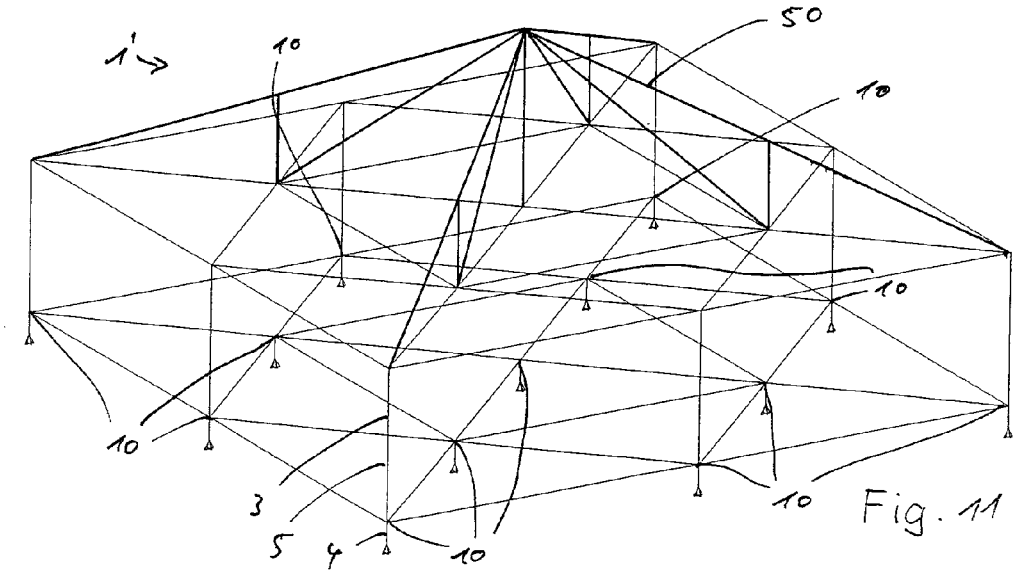
FIG. 11 is a schematic view of a building in which story supports are replaced by a suspended construction.

In order to increase the size of the support-free space, individual or a plurality of story supports can also be dispensed with and be replaced by a spatial truss 50, such as is shown in FIG. 11, which can also be used as a bearing for traditional or special roof constructions.

It is generally the case that it may be advantageous or necessary during assembly to carry out an interim reinforcement of the building being constructed and/or of the base elements which have already been assembled, for example by shuttering supports with ground nails which are for example screwed onto the steel angled supports of the story supports.

It is also possible to produce all the rims of the skeleton structure from jointly load-bearing steel profiles; this may facilitate assembly.

The described method or the described design allows a very broad range of buildings to be produced, despite the fact that only a very limited number of different, but completely prefabricated base elements are necessary. The skeleton structure preferably consists of individual founded steel supports which are supplemented with planar elements made of different materials and with a broad range of surfaces to form a building. The shape of the roof can also vary. The buildings can be made outstandingly energy-efficient in an outstandingly economical manner as a consequence of large-scale manufacture by directly using, in addition to passive heat protection, also solar energy, for example, via solar and photovoltaic installations which are economically produced in large quantities or flexible glazings allowing simply functioning "heat traps" to be achieved.

From the point of view of the culture of living, the possibility, which is inherent to the system, of building houses with atria (including "genuine" atria with, for example pyramid-shaped, upper glazings with push rods for opening and closing) and any peripheral pergolas which are flexibly glazed in their entirety or in part vertically inwardly or horizontally upwardly, depending on the season, would seem particularly beneficial. The possibility, which is useful with regard to improving living value and energy efficiency, of repositioning the building in line with the sun is an important approach.

All of the components of the houses are produced consistently under conditions of large-scale industrial production with all its possibilities for streamlining and automation and also ideal possibilities for quality control and assurance. Even the sole remaining, location-contingent uncertainty, namely the construction ground, is made controllable in very many cases as a result of the adjustment, which is possible at all times, of the height of individual bearings of the support elements.

As a consequence of the extremely simple assembly, which can be carried out even by non-professionals with very little scope for error, and the extremely short assembly time, human error and weather conditions are all but ruled out as possible causes of damage. However, the greatest advantage is the almost unlimited flexibility of the buildings. This begins with the change, which is possible at all times at low cost, of the size of the building by adding or removing base elements in the event of possible reuse of existing outer wall elements, for example, and thus adaptation to the users' space requirements or financial situation. Outer wall and ceiling elements can be moved using hand-operated and hand-movable assembly aids. The flexibility continues in the possibilities of adapting to the seasons, in that for example regions used in the summer as loggias or terraces are converted in the cold season into winter gardens or closed spaces at very low cost in possible manual assembly or using the aforementioned assembly aids. Even atria which are open in summer can be roofed or reduced in size in winter. The building as a whole can also easily be completely disassembled and reconstructed intact at a different location.

Buildings of the described design also have a number of advantages from the point of view of energy. Thus, for example, the production costs of photovoltaic and solar installations can be greatly reduced as a consequence of the large-scale production which is possible in standardized assembly and the efficiency of these installations can also be greatly increased by the possibility of repositioning the building in line with the sun. The region below the buildings can be used for the grounding (possibly with the additional use of foundation piles) of heat pumps.

For all the advantages mentioned, the listing of which is not and cannot in any way be complete, this design does not convey any impression of low solidity, instability or even a provisional arrangement. The stability and durability of the buildings are very high, wherein there is additionally the possibility of repair or renovation measures which are very easy to carry out—even in partial regions—up to the general overhaul of individual components in the factory.

The possible architectural diversity is vast, despite the fact that all the buildings consist of exchangeable identical or similar components and elements. In addition to an efficient, partly automated CAD-supported design and planning process, this also offers the possibility of exchanging parts or of using new or used parts. However, the listed advantages of the new design also lead almost inevitably to a new type of life and living. For example, the possibility of using protected but ample natural-floored atria throughout the year will in many cases certainly help to form a new sense of life.

LIST OF REFERENCE NUMERALS

1 modular building
2 foundation element
3 support element

4 installation story support
5 story support
6 floor element
7 ceiling element
8 outer wall element
9 construction ground
10 node and corner points
11 hollow tube
12 nut
13 GEWI rod
14 head plate
15 through-openings
16 angled profile
17 lower end plate
18 upper end plate
19 mandrel
20 receiving opening
21 corner
22 through-hole
23, 24 through-holes
25, 26 legs
27 tip
28 center
29 central region
30 projection
31 hypotenuse side
32 cathetus side
33 lower side
34 lateral side
35 lower rim
36 upper rim
37 skeleton structure element
38 outer weather protection
39 inner wall layer
40 pin
41 locking sleeve
42 locking opening
43 guide
44 lever rod
45, 46 arrow directions
47 outer corner
48 finished element
49 free space
50 truss
51 sealing layer
52 upturned rims
53 installation story walls
54 installation strings
55 wheels
56 rails
57 downpipe
58 foil
59 floating body

The invention claimed is:

1. A modular building, comprising:

a plurality of basic elements together forming the modular building, said basic elements including:

supporting elements comprising at least: foundation elements; supports of an installation story; and support elements which form story supports when connected together; and planar elements comprising at least wall elements, floor elements, and ceiling elements;

wherein said support elements are formed of angled profiles which have an opening angle corresponding to corner angles of said floor elements and said ceiling elements;

wherein said supporting elements and said planar elements are detachably connected with one another and to one another;

wherein individual said elements at the periphery of the building can be added, exchanged, or removed, due to at least one of a specific shape, size, composition, position in the overall structure and mutual fastening thereof, individually or in groups during use, without impairing, damaging or destroying remaining individual said elements or the overall structure, to adapt the building to changing number and/or requirements of the users.

2. The building according to claim 1, wherein said floor elements and said ceiling elements have node or corner points, and the building is foundationally supported merely exactly below said node or corner points of said floor and ceiling elements on a construction ground on reusable planar foundation elements, with supports of the installation story fastened onto the foundation elements, and wherein a length adjustability of said supports of the installation story allows differences in height in a foundation grade or differences in subsidence to be compensated for, and an extension or reduction of the area of the building is possible by respectively adding or removing foundation elements and, also, supports of the installation story.

3. The building according to claim 2, formed, over a height of said supports of the installation story, with a crawl-high installation story that is delimited horizontally by the construction ground and a plane of said floor elements and laterally by installation story walls, and in which installation pipes, wires and channels are laid, added, relaid or removed in any desired manner during use.

4. The building according to claim 2, wherein said foundation elements are wheels to be driven with lateral guidance on rails laid in a circular shape or an arc of a circle to thereby make the building revolvable around a vertical axis.

5. The building according to claim 4, wherein the building is revolvable around a vertical axis to follow a position of the sun.

6. The building according to claim 1, wherein said floor elements and said ceiling elements, are substantially identical in a horizontal shape and size, and are each mounted at the corners individually in, or on, support elements formed of angled profiles having an opening angle corresponding to corner angles of said floor elements and said ceiling elements, such that, at the node points of said floor elements and said ceiling elements, vertically extending bundles made of support elements fastened by screws to the story supports that are connected in a first story onto a respective head plate of said support of the installation story and in further stories onto the head plate of said support elements located therebelow, allowing said story supports to be adapted to an extension or reduction in size of a overall structure by adding or removing respective support elements.

7. The building according to claim 1, wherein said wall elements comprise story-high outer wall elements having a length adapted to the corresponding lengths of said floor elements and which are configured to be built in, removed or exchanged in a direction of horizontal movement without influencing respectively adjoining elements.

8. The building according to claim 1, which comprises a flat roof with roof ceiling elements having peripheral upturned rims and being individually drained through at least one downpipe per ceiling element, allowing ceiling elements to be added or to be removed without impairing the drainage system of the other ceiling elements.

9. The building according to claim 8, wherein a space that is delimited laterally by the peripheral upturned rims and downwardly by a base area is sealed in a liquid-tight manner and is covered upwardly by a dark foil, if water heating is intended, or a foil that is transparent to UV light, if water sterilization is intended, as a liquid storage system.

10. The building according to claim 9, which further comprises a centrally arranged hole within the covering foil, and a floating body disposed around or adjacent said hole.

11. The building according to claim 1, wherein said wall elements have channel-like recesses formed therein, extending along or adjacent one or more rims parallel to a particular one of said one or more rims, for receiving installations.

* * * * *